US005417060A

United States Patent [19]

Ishida et al.

[11] Patent Number: 5,417,060

[45] Date of Patent: May 23, 1995

[54] AIR FUEL RATIO CONTROL APPARATUS FOR AN INTERNAL COMBUSTION ENGINE

[75] Inventors: Kazumi Ishida, Nishikasugai; Hiroshi Haraguchi, Kariya; Masakazu Hishinuma; Akio Fujiwara, both of Yokohama, all of Japan

[73] Assignees: Nippondenso Co., Ltd., Tokyo; Tokyo Gas Co., Ltd., Kariya, both of Japan

[21] Appl. No.: 169,762

[22] Filed: Dec. 20, 1993

Related U.S. Application Data

[63] Continuation of Ser. No. 882,649, May 13, 1992, abandoned.

[30] Foreign Application Priority Data

May 13, 1991 [JP] Japan ..... 3-107340

[51] Int. Cl.[6] ..... F01N 3/20

[52] U.S. Cl. ..... 60/276; 60/285; 123/691; 123/697

[58] Field of Search ..... 60/274, 276, 285; 123/691, 697

[56] References Cited

U.S. PATENT DOCUMENTS 4,251,989 2/1981 Norimatsu .
4,253,302 3/1981 Asane .
4,362,605 12/1982 Tanaka .
4,739,614 4/1988 Katsuno et al. .
4,834,051 5/1989 Tanaka ..... 60/276
4,915,080 4/1990 Nakaniwa .
5,095,878 3/1992 Kumagai ..... 60/276
5,101,625 4/1992 Sugino ..... 60/276

FOREIGN PATENT DOCUMENTS 61-286550 12/1986 Japan .

*Primary Examiner*—Douglas Hart
*Attorney, Agent, or Firm*—Cushman, Darby & Cushman

[57] ABSTRACT

An air fuel ratio controlling apparatus for an internal combustion engine, comprises: a catalytic converter, provided in an exhaust system for purifying an exhaust gas of the engine; a first oxygen density sensor, provided upstream from the catalytic converter in the exhaust system, responsive to a first oxygen density of a first exhaust gas of the engine for detecting whether an air fuel ratio of the engine is in a rich condition or a lean condition with respect to a theoretical air fuel ratio of the engine; a second oxygen density sensor, provided downstream from the catalytic converter in the exhaust system, responsive to a second oxygen density of a second exhaust gas passed through the catalytic converter for detecting whether the air fuel ratio of the engine is in a rich or a lean condition with respect to a theoretical air fuel ratio of the engine; and an air fuel ratio control portion for controlling the air fuel ratio in accordance with the detection results of the first and second oxygen sensors, wherein; the first oxygen sensor has a function for oxidizing and reducing a specific component more powerful than that of the second oxygen density sensor.

22 Claims, 13 Drawing Sheets

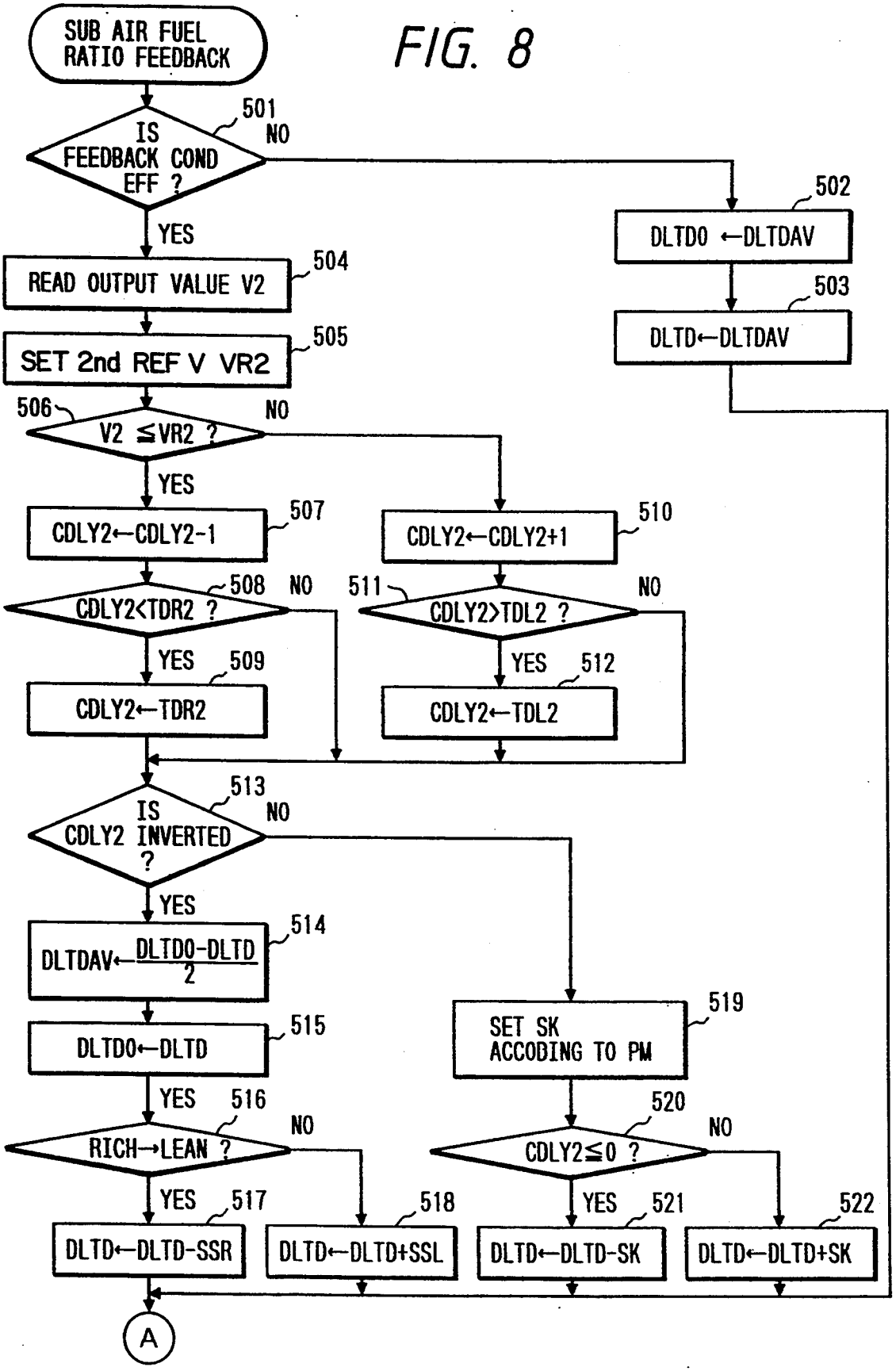
FIG. 8
SUB AIR FUEL RATIO FEEDBACK
501
IS FEEDBACK COND EFF ?
NO
YES
502
DLTD0 ←DLTDAV
503
DLTD←DLTDAV
504
READ OUTPUT VALUE V2
505
SET 2nd REF V VR2
506
V2 ≤VR2 ?
NO
YES
507
CDLY2←CDLY2-1
510
CDLY2←CDLY2+1
508
CDLY2<TDR2 ?
NO
511
CDLY2>TDL2 ?
NO
YES
509
CDLY2←TDR2
YES
512
CDLY2←TDL2
513
IS CDLY2 INVERTED ?
NO
YES
514
DLTDAV←(DLTD0-DLTD)/2
515
DLTD0←DLTD
519
SET SK ACCODING TO PM
YES
516
RICH→LEAN ?
NO
520
CDLY2≦0 ?
NO
YES
517
DLTD←DLTD-SSR
518
DLTD←DLTD+SSL
YES
521
DLTD←DLTD-SK
522
DLTD←DLTD+SK
A

FIG. 10A V1

FIG. 10B BEFORE DELAY PROCESSING

FIG. 10C AFTER DELAY PROCESSING

FIG. 10D FAF

FIG. 10E V2

FIG. 10F BEFORE DELAY PROCESSING

FIG. 10G AFTER DELAY PROCESSING

FIG. 10H DLTD

FIG. 10I WINDOW POSITION

AIR FUEL RATIO CONTROL APPARATUS FOR AN INTERNAL COMBUSTION ENGINE

This is a continuation of application Ser. No. 07/882,649, filed on May 13, 1992, which was abandoned upon the filing hereof.

BACKGROUND OF THE INVENTION

1. Field of the Invention

This invention relates to an air fuel ratio control apparatus for an internal combustion engine and particularly to an air fuel ratio control apparatus for an internal combustion engine, having first and second oxygen sensors provided at downstream and upstream from a catalytic converter of the internal combustion engine respectively.

2. Description of the Prior Art

An air fuel ratio control apparatus for an internal combustion engine is known which controls an air fuel ratio of an internal combustion engine around a theoretical air fuel ratio in accordance with an output signal of an oxygen sensor ($O_2$sensor) provided upstream from a catalytic converter to increase an purification ratio of the exhaust gas.

Moreover, an air fuel ratio control apparatus for an internal combustion engine is known which comprises first and second oxygen sensors provided downstream and upstream from a catalytic converter of the internal combustion engine and compensates an output of the first oxygen sensor provided upstream from the catalytic converter in accordance with an output of the second oxygen sensor provided downstream from the catalytic converter to prevent decrease in controlability due to change or dispersion in a characteristic of the first oxygen sensor. For example, a delay time of the air fuel ratio control by the first oxygen sensor is controlled in accordance with the output of the second oxygen sensor. This is described in Japanese patent application provisional publication No. 61-286550 (corresponding patent application, U.S. Pat. No. 4,739,614).

FIG. 3A is a cross-sectional view of the prior art oxygen sensor mentioned above. FIG. 3B is an enlarged view of a portion A shown in FIG. 3A. As shown in FIG. 3A, each of two oxygen sensors used in the air fuel ratio control apparatus mentioned above comprises an well-known solid electrolyte 31 formed in a tube with one open end and one close end, made of zirconia ($ZrO_2$) to which yttrium oxide ($Y_2O_3$) or the like is add, electrodes 32 and 33 made of platinum or the like provided at inner surface and outer surfaces of the tube of the solid electrolyte 31, and a protective layer 34 for protecting the oxygen sensor itself. This oxygen sensor does not have any function for oxidizing or reducing specific substances in an unbalanced exhaust gas, for example, carbon monoxide (CO), hydrogen ($H_2$), nitric oxide (NOx), or the like.

Therefore, the presence of the specific substances causes the characteristic of take first oxygen sensor provided upstream from the catalytic converter to deviate from the characteristic in the condition that these substances would be absent, to the lean or rich condition. More specifically, for example, if a large of amount of CO or $H_2$ are included in an exhaust gas, the characteristic of the first oxygen sensor deviates from that in the normal condition to the condition of lean in oxygen density because an interval is required for sufficient oxidizing reaction on the surface of the electrode 33. Therefore, such deviation prevents surer control of the air fuel ratio of the internal combustion engine to a theoretical air fuel ratio.

The characteristic of the second oxygen sensor provided downstream from the catalytic converter does not largely deviate to on the condition of rich or lean in oxygen density because the specific substances in the unbalanced exhaust gas are purified to a certain degree by the catalytic converter. However, there is a problem that if the output of the first oxygen sensor is compensated in accordance with the output of the second oxygen sensor, a control frequency of the air fuel ratio control decreases, so that controlability decreases because the output of the first oxygen sensor deviates from that in the normal condition. Further, the purification ratio of the catalytic converter decreases as shown in FIG. 4 showing purification ratio-control frequency characteristic.

Moreover, the catalytic converter deteriorates with years for which it has been used, so that it would not function sufficiently. If such problem occurs, the characteristic of the second oxygen sensor provided downstream from the catalytic converter varies, so that the air fuel ratio of the internal combustion engine cannot not be controlled to improve the purification of the catalytic converter in accordance with the output of the second oxygen sensor.

SUMMARY OF THE INVENTION

The present invention has been developed in order to remove the above-described drawbacks inherent to the conventional air fuel ratio controlling apparatus.

According to the present invention there is provided a first air fuel ratio controlling apparatus for an internal combustion engine, comprising: a catalytic converter, provided in an exhaust system of the engine for purifying an exhaust gas of the engine; a first oxygen density sensor, provided upstream from the catalytic converter in the exhaust system, responsive to a first oxygen density of an exhaust gas of the engine for detecting whether an air fuel ratio of the engine is in a rich condition or a lean condition with respect to a theoretical air fuel ratio of the engine; a second oxygen density sensor, provided downstream from the catalytic converter in the exhaust system, responsive to a second oxygen density of an exhaust gas passed through the catalytic converter for detecting whether the air fuel ratio of the engine is in a rich or a lean condition with respect to a theoretical air fuel ratio of the engine; and an air fuel ratio control portion for controlling the air fuel ratio in accordance with the detection results of the first and second oxygen sensors, wherein the first oxygen sensor has more capability to oxidize and reduce a specific component included in the exhaust gas than the second oxygen sensor.

According to the present invention, there is also provided a second air fuel ratio control apparatus as mentioned in the first air fuel ratio control apparatus, wherein the first oxygen density sensor comprises: a solid electrolyte formed in a tube having one open end and one closed end; a first electrode layer coated on a portion of the inner surface of the tube; a second electrode layer covering a portion of the outer surface of the tube, the solid catalyst and the first and second electrode layers forming an oxygen concentration cell; a protective layer covering the second electrode; and a catalyst layer, covering the protective layer, for oxidizing or reducing the specific component.

According to the present invention there is also provided a third air fuel ratio control apparatus as mentioned in the first air fuel ratio control apparatus wherein the first oxygen density sensor comprises: a solid electrolyte formed in a tube having one open end and one closed end; a first electrode layer coated on a portion of the inner surface of the tube; a second electrode layer covering a portion of the outer surface of the tube, the solid catalyst and the first and second electrode layers forming an oxygen concentration cell; and a protective layer covering the second electrode.

BRIEF DESCRIPTION OF THE DRAWINGS

The object and features of the present invention will become more readily apparent from the following detailed description taken in conjunction with the accompanying drawings in which:

FIGS. 8 and 9 show a flow chart representing the sub-air fuel ratio feedback control routine of this embodiment;

The same or corresponding elements or parts are designated as like references throughout the drawings.

DETAILED DESCRIPTION OF THE INVENTION

Hereinbelow will be described an embodiment of this invention of an air fuel ratio control apparatus applied to a gas engine whose fuel is mainly composed of methane gas, with reference to drawings.

Figure 1:
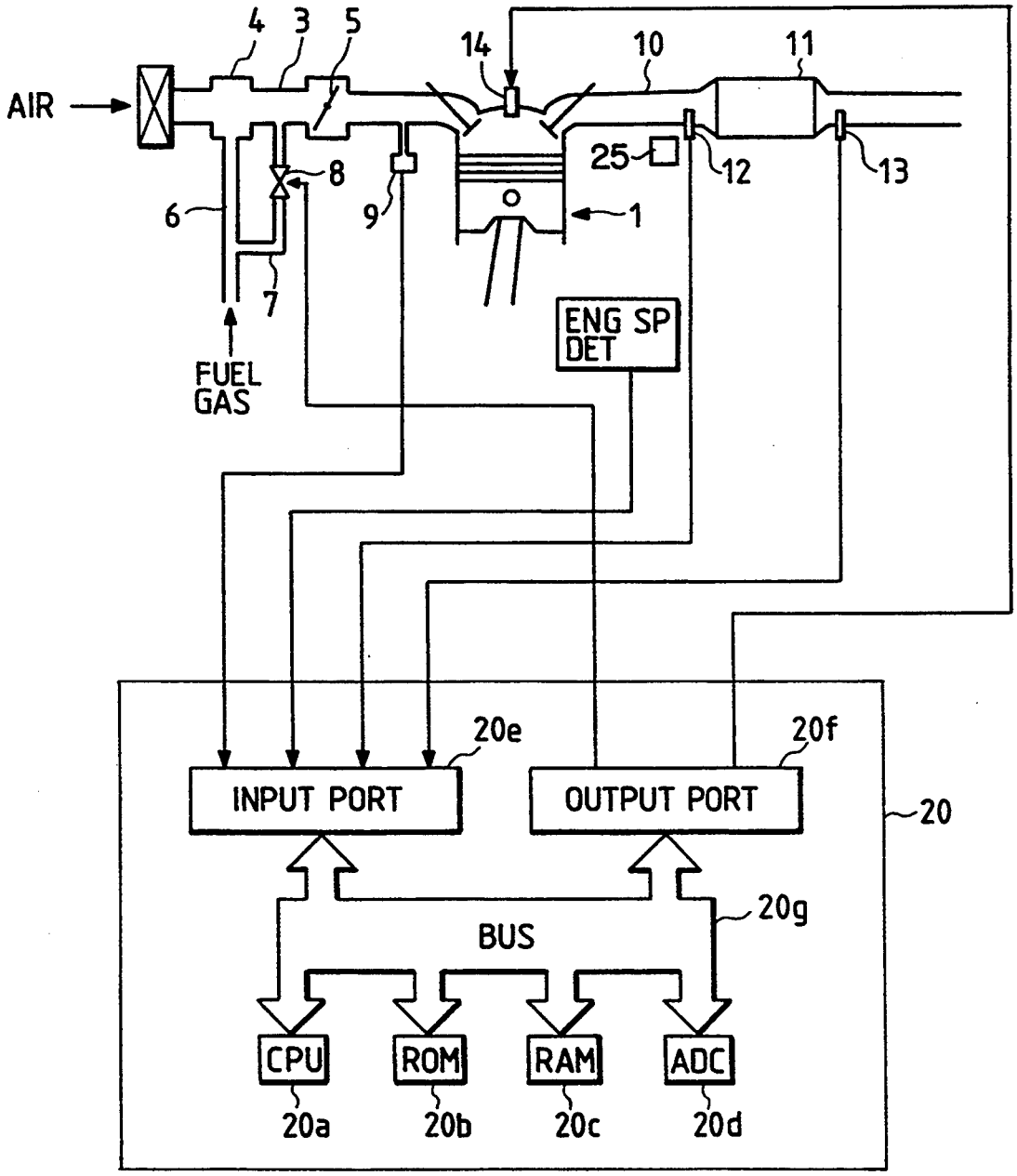
FIG. 1 is a block diagram of this embodiment of an air fuel ratio control apparatus.

FIG. 1 is a block diagram of this embodiment of the air fuel ratio control apparatus. Numeral 1 is a gas engine (internal combustion engine). An intake air system of the gas engine 1 comprises an air cleaner 2 for filtering the intake air and an intake air pipe 3 for introducing the air fuel mixture into the engine 1. In the intake air pipe 3, there are provided a mixer 4 for mixing the intake air from the air cleaner 2 with a fuel gas from a not-shown fuel supply source through a main fuel supply passage 6 to produce an air fuel mixture gas which is leaner than a theoretical air fuel ratio and a choke valve 5 for controlling a flow rate of the air fuel mixture gas to the engine 1, and a bypass fuel supply passage 7 for supplying the fuel gas from the not-shown gas supply source to a downstream of the mixture 4. Moreover, a control valve 8 for controlling air fuel ratio is provided to the bypass fuel supply passage 7 for adjusting a flow rate of the fuel gas (a flow rate of the bypass fuel supply passage) to control the air fuel ratio of the air fuel mixture gas to a desired value. The choke valve 5 controls the total flow rate of the air fuel mixture gas coming from the mixture 4 and from the bypass fuel supply passage 7 to the engine 1. At the downstream of the choke valve 5 in the intake air pipe 8, an intake air pressure sensor 9 for detecting an intake air pressure PM is provided.

In an exhaust system of the gas engine 1, an exhaust pipe 10 for introducing an exhaust gas from the gas engine 1 is provided. In the exhaust pipe 10, a catalytic converter rhodium 11 for cleaning deleterious substances included in an exhaust gas is provided. First and second oxygen sensors ($O_2$ sensors, or oxygen density sensors) 12 and 13 for detecting an air fuel ratio of the air fuel mixture supplied to the gas engine i are provided at upstream and downstream of the catalytic converter rhodium 11 respectively. As well known, each of the first and second oxygen density sensors 12 and 13 has a characteristic that its output is inverted at a theoretical air fuel ratio and detects whether the air fuel ratio is in a rich condition or in a lean condition with respect to a theoretical air fuel ratio using this characteristic.

An ignition plug 14 provided at the cylinder head of the internal combustion engine 1 ignites the air fuel mixture gas introduced in the engine 1. An engine speed sensor 15 detects an engine speed NE of the engine 1.

The electric control unit (ECU) 20 comprises a central processing unit (CPU) **20*a*, a read only memory (ROM) 20*b* where control programs or the like are stored in advance, a random access memory (RAM) 20*c* for temporally storing operation data or the like, an analog to digital converter (ADC) 20*d*, an input port circuit 20e for inputting detected signals from the various sensors mentioned above, and an output port circuit 20f for outputting control signals for the control valve 8 and the ignition plug 14 or the like, and bus lines 20g for interconnecting between these elements in the electric control unit 20**.

Hereinbelow will be described the oxygen sensors 12 and 13 which is one of features of this invention. FIG. 3C is a cross-sectional view of the oxygen sensor 12 mentioned above.

As shown in FIG. 3C, the oxygen sensor 12 comprises an well-known solid electrolyte 31 formed fin a tube with one open end and one close end, made of zirconia ($ZrO_2$) to which yttrium oxide ($Y_2O_3$) or the like is add, electrodes 32 and 33 made of platinum or the like coated on inner surface and outer surfaces of the tube of the solid electrolyte 31 respectively, a protective layer 34 for protecting the oxygen sensor itself covering the electrode 33, and a catalyst layer 35 covering the protective layer 34. The solid electrolyte 31 and the electrode 32 and 33 form an oxygen concentration cell. The catalyst layer 35 functions as a catalyst to oxidize deleterious substances included in an exhaust gas such as hydrocarbon, particularly methane $CH_4$ when that is the main component of the fuel, and further to reduce nitrogen oxides (NOx) included in the exhaust gas.

Figure 3A:
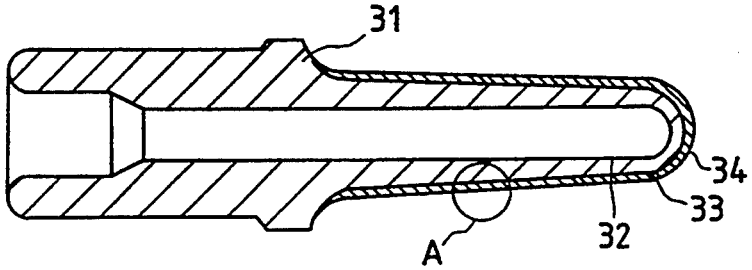
FIG. 3A PRIOR ART
FIG. 3A is a cross-sectional view of a prior art oxygen sensor.
Figure 3B:
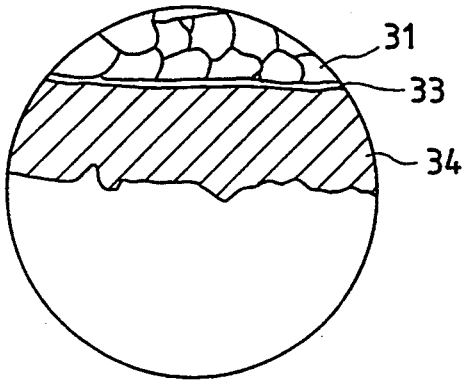
FIG. 3B PRIOR ART
FIG. 3B is an enlarged view of a portion A of the prior art oxygen sensor shown in FIG. 3A.
Figure 3C:
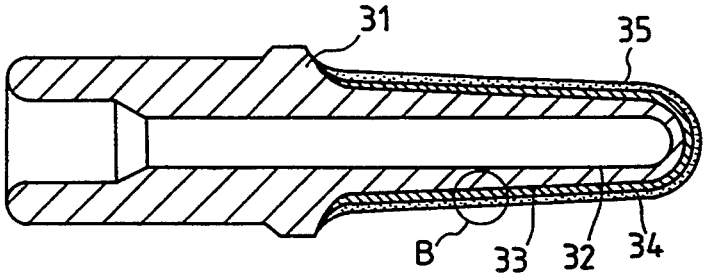
FIG. 3C is a cross-sectional view of the oxygen sensor of this invention.
Figure 3D:
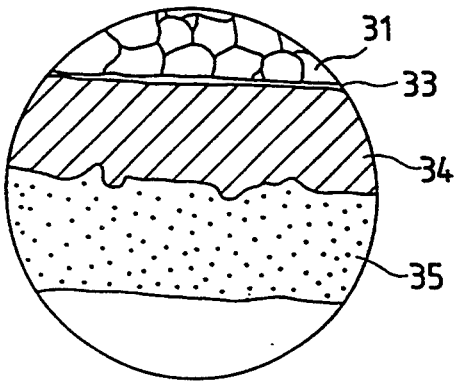
FIG. 3D is an enlarged view of a portion B of the oxygen sensor of this invention.
Figure 4:
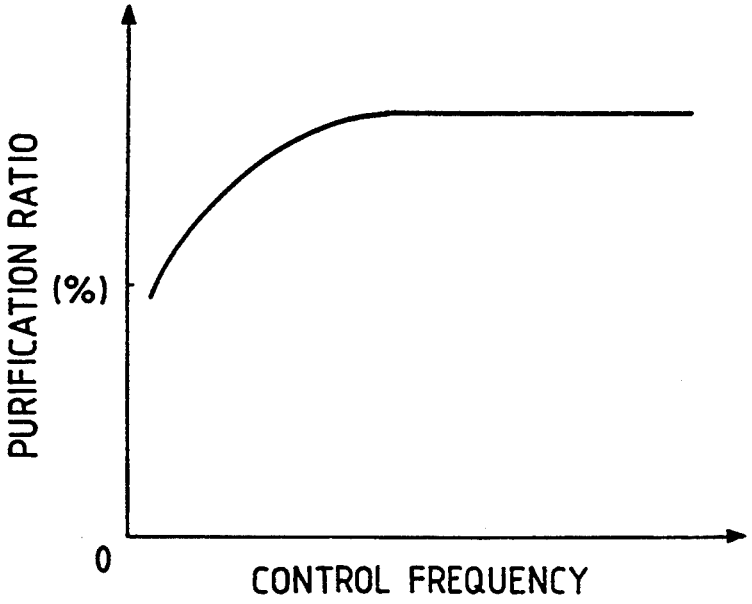
FIG. 4 PRIOR ART
FIG. 4 shows a purification ratio control frequency characteristic of the prior art.

FIG. 3D is an enlarged view of a portion B shown in FIG. 3C. The catalyst layer 35 is mainly composed of 0.4 mg of platinum, and 0.01 mg of palladium, and 0.4 mg of rhodium and is formed by the technique disclosed in Japanese utility model application provisional publication No. 59-10616 for example.

Figure 2A:
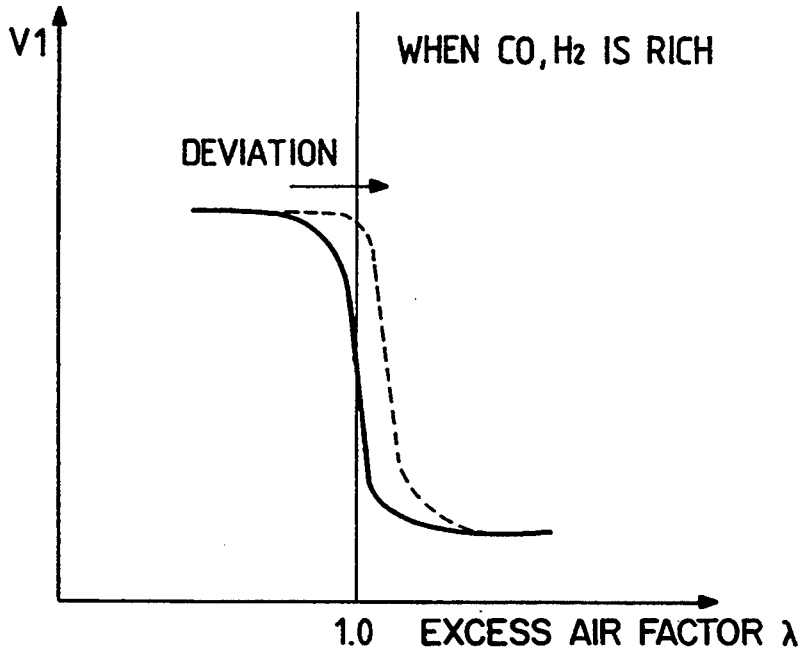
FIGS. 2A and 2B show electromotive force to air suppression characteristics of an oxygen sensor of this embodiment.
Figure 2B:
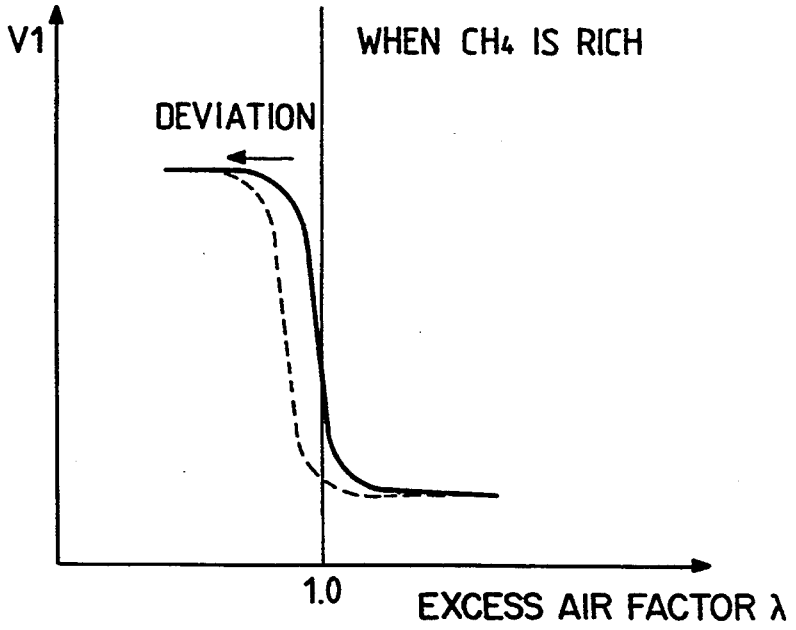

As described above, in the ordinary type oxygen sensor without the catalyst layer 35 shown in FIGS. 3A and 3B, an electromotive force does not change at the point where the excess air factor of the air-fuel mixture $\lambda$ equals to 1, as shown by dashed lines in FIGS. 2A and 2B which illustrates electromotive force to excess air factor characteristics because a time interval is necessary for sufficient oxidation reaction of exhaust gas components (HC and CO) on the surface of the electrode 33 when HC and CO are included in a large amount in an unbalanced combustion gas and a low temperature of an exhaust gas. That is, its electromotive force characteristic deviates from that of the theoretical air fuel ratio to the side of lean.

However, the catalyst layer 35 prevents the electromotive force characteristic to deviate from that of the theoretical air fuel ratio as shown in FIGS. 2A and 2B because an oxidation reaction is carried out in the catalyst layer 35 to some extent, so that the components included in the unequilibrated combustion gas or in the exhaust gas at a low temperature are sufficiently oxidized in a short time interval inside the catalyst layer 35 through which the gas reaches the electrode 33. Moreover, the catalyst layer 35 reduces $CH_4$ to prevent the output of the oxygen sensor to deviate, so that the electromotive force characteristic can be controlled to that of the theoretical air fuel ratio.

On the other hand, the oxygen sensor 13 provided downstream from the catalytic converter rhodium 11 is an ordinal type of oxygen sensor having no catalyst layer as shown in FIGS. 3A and 3B. Hereinbelow will be described an effect of using the ordinary type oxygen sensor having no catalyst layer, provided downstream from the catalytic converter rhodium 11, that is, an effect of using the oxygen sensor whose catalytic function is low (because platinum has a catalytic function).

Figure 5A:
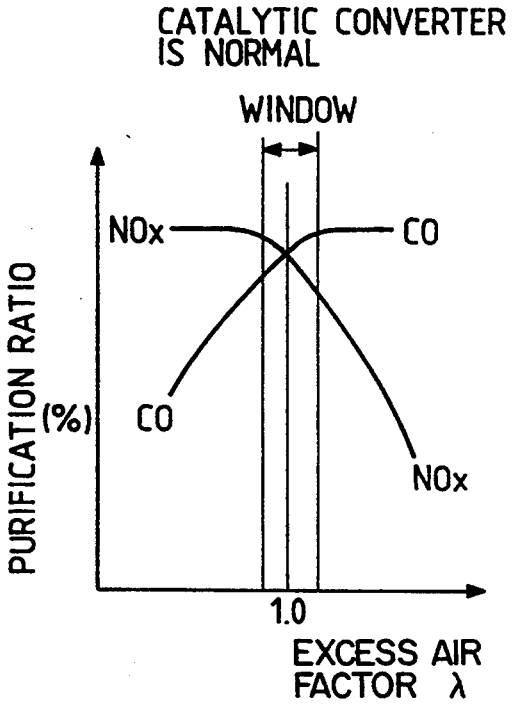
FIG. 5A shows a catalytic purification ratio characteristic of CO and NOx included in an exhaust gas, represented with respect to excess air factor λ when the catalytic converter rhodium is in a normal condition.
Figure 5C:
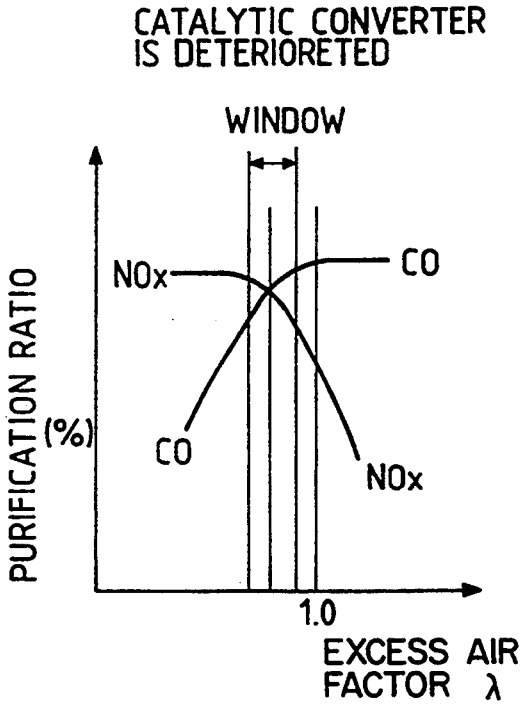
FIG. 5C shows a catalytic purification ratio characteristic of CO and NOx included in the exhaust gas represented with respect to excess air factor λ when the catalytic converter rhodium is deteriorated.
Figure 5B:
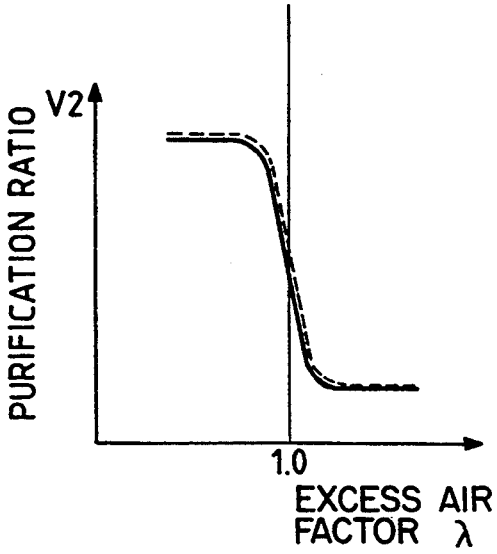
FIG. 5B shows an output characteristic of the oxygen sensor represented with respect to excess air factor λ when the catalytic converter rhodium is in a normal condition.
Figure 5D:
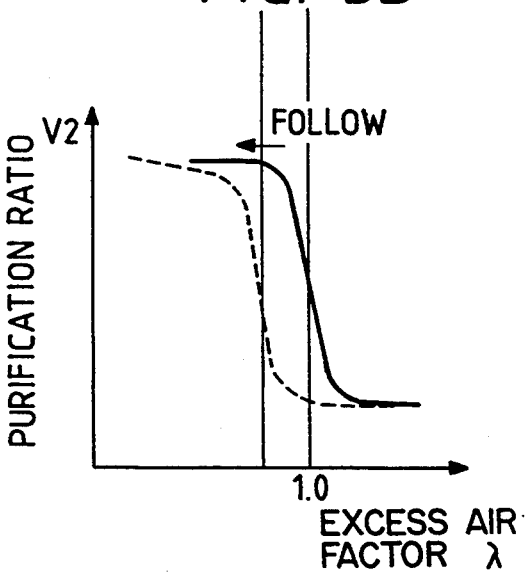
FIG. 5D shows an output characteristic of the oxygen sensor represented with respect to excess air factor λ when the catalytic converter rhodium is deteriorated.

FIG. 5A shows a catalytic purification ratio characteristic of CO and NOx included in the exhaust gas represented with respect to an excess air factor $\lambda$ when the catalytic converter rhodium 11 is normal. FIG. 5B shows an output characteristic of the oxygen sensor 13 represented with respect to the excess air factor $\lambda$ when the catalytic converter rhodium 11 is normal. FIG. 5C shows a catalytic purification ratio characteristic of CO and NOx included in the exhaust gas represented with respect to the air suppression rate 7 when the catalytic converter rhodium 11 is deteriorated. FIG. 5D shows an output characteristic of the oxygen sensor 13 represented with respect to the excess air factor $\lambda$ when the catalytic converter rhodium 11 is deteriorated. The purification ratio PR is defined by: $PR=\{(IASC-OASC)/IASC\}\times 100\%$ where IASC is an amount of the specified component (for example, HC, CH4, or CO) included in an exhaust gas incoming to the catalytic converter rhodium 11 and OASC is an amount of the specified component included in an exhaust gas outputted from the catalytic converter rhodium 11.

As shown in FIGS. 5A and 5B, the catalytic purification ratio is high around an excess air factor $\lambda$ of 1 (theoretical air fuel ratio). However, when the catalytic converter rhodium 11 is deteriorated, a region where the catalytic purification ratio is high (hereinafter referred to as an window) shifts to the rich side as shown in FIGS. 5C and 5D. The shift of the window position results from various causes. As one of them, it is considered that the characteristic of $NO_x$ purification deteriorates due to a large amount of oxygen in the exhaust gas. The large amount of oxygen exists because the oxygen is not used for an oxidation reaction in the catalytic converter as a result of deterioration of the catalytic converter.

As mentioned above, if the oxygen sensor with high catalytic function (i.e., more capable of oxidizing or reducing a component of the exhaust-gas) is provided downstream of the catalytic converter, the electromotive force of the oxygen sensor always changes at about a point at which the excess air factor $\lambda$ is 1, as shown by the solid line in FIG. 5D. This is true even when the converter is deteriorated. As a result, the air-fuel ratio is controlled at the point of the $\lambda=1$ where the catalytic converter has less capability of purifying $NO_x$. On the other hand, by providing the oxygen sensor with low catalytic function (i.e., less capable of oxidizing or reducing a component of the exhaust-gas) downstream of the catalytic converter, the changing point of the electromotive force of the oxygen sensor moves towards the area in which the catalytic converter has the most capability of $NO_x$ purification, as shown by the dashed line in FIG. 5D. In this manner, the air-fuel ratio is automatically controlled following the window of the catalytic converter.

Therefore, in the embodiment of the invention, the oxygen sensor 12 having a powerful catalytic function is provided upstream from the catalytic converter rhodium 11 and the oxygen sensor 13 having a low catalytic function is provided downstream from the catalytic converter rhodium 11. This causes the air fuel ratio to be controlled to the theoretical air fuel ratio because the deviation of the output characteristic does not occur though the oxygen sensor 12 is exposed to the unbalanced combustion gas. Further, the air fuel ratio can be controlled in response to deviation of the window position surely to that for obtaining a high catalytic purification ratio always in the catalytic converter rhodium 11 by the method mentioned later.

Hereinbelow will be described a method of controlling of the air fuel ratio of the gas engine 1 using the oxygen sensors 12 and 13, that is, a method of calculation of a control amount of the control valve 8 with reference to FIGS. 6 to 9.

Figure 6:
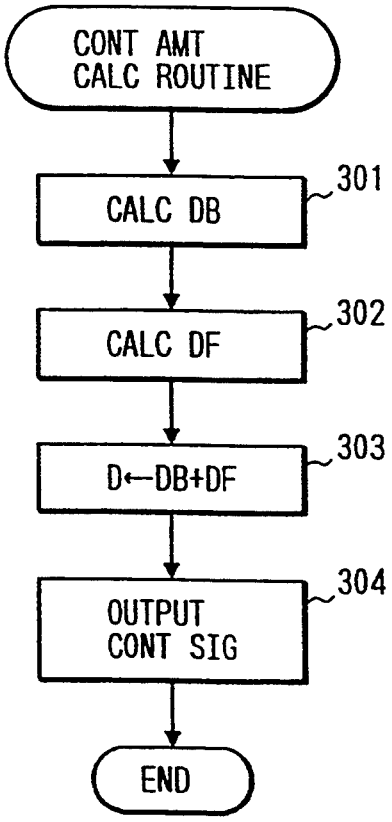
FIG. 6 shows a flow chart showing a control amount calculation routine of this embodiment.

FIG. 6 shows a flow chart showing a control amount calculation routine for calculating a control amount D of the control valve 8.

Figure 11:
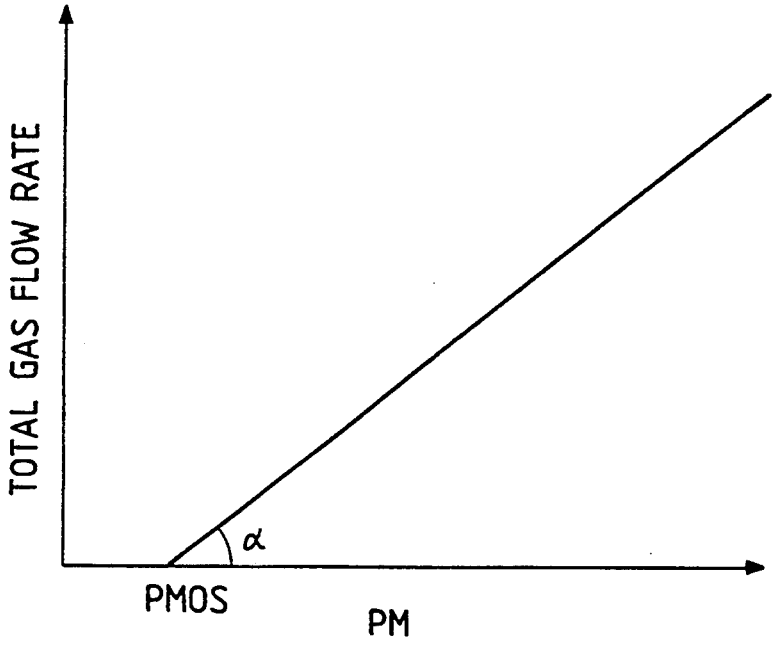
FIG. 11 shows a relation between the intake air pressure PM and the total gas flow rate of this embodiment.
Figure 12:
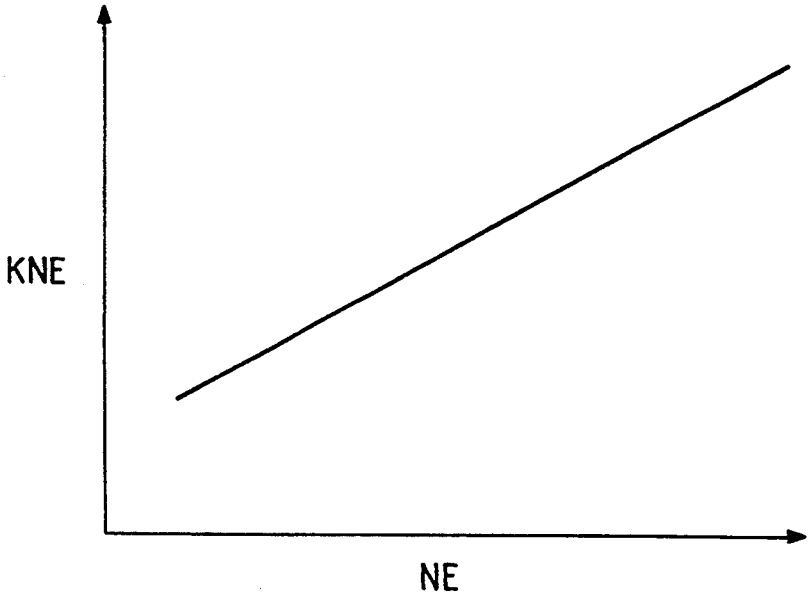
FIG. 12 shows a relation between the engine speed NE and the engine speed compensation coefficient KNE of this embodiment.
Figure 13:
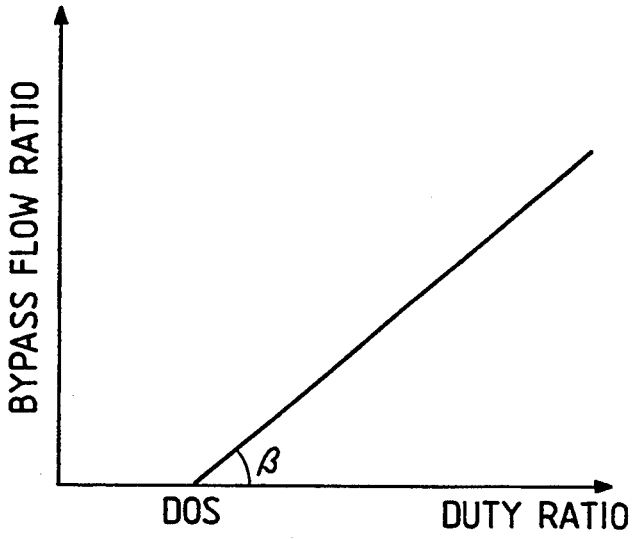
FIG. 13 shows a relation between the duty ratio and the bypass flow rate of this embodiment.

At first, in a step 301, a basic control amount DB is calculated using an intake air pressure PM detected by the intake air pressure sensor 9 and an engine speed NE detected by the engine speed sensor 15 in accordance with the following equation.

$$DB \rightarrow (PM - PMOS) \times KPMB \times KNE \times KDB + DOS \quad (1)$$

where PMOS is a value corresponding to an offset existing in the relation between the intake air pressure PM and the total gas flow rate shown in FIG. 11, which is set in accordance with each gas engine; KPMB is a conversion coefficient for converting the intake air pressure to a duty ratio; KNE is an engine speed compensation coefficient set in accordance with the engine speed NE because there is a relation between the engine speed NE and the engine speed compensation coefficient KNE as shown in FIG. 12; KDB is a compensation coefficient set in accordance with the intake air pressure PM and the engine speed NE; and DOS is a value corresponding to an offset existing in the relation between the duty ratio and the bypass flow rate shown in FIG. 13 which is set in accordance with each gas engine as similar to PMOS.

In the following step 302, a compensation control amount DF is calculated using the intake air pressure PM, the engine speed NE, and air fuel ratio compensation coefficient FAF in accordance with the following equation.

$$DF \rightarrow (PM - PMOS) \times KPMF \times KNE \times FAF \quad (2)$$

where KPMF is a value set in accordance with the following equation, using an incline $\alpha$ of the curve showing a relation between the intake air pressure PM and the total gas flow rate and the incline $\beta$ of a curve showing a relation between the duty ratio and the bypass flow rate.

$$KPMF \rightarrow \alpha/\beta \quad (3)$$

In the following step.303, the control amount D is calculated in accordance with the basic control amount DB and the compensation control amount DF calculated as mentioned above. In the step 304, a control signal corresponding to the control amount D is outputted and sent to the control valve 8. Then, the control amount calculation routine is finished.

Figure 7:
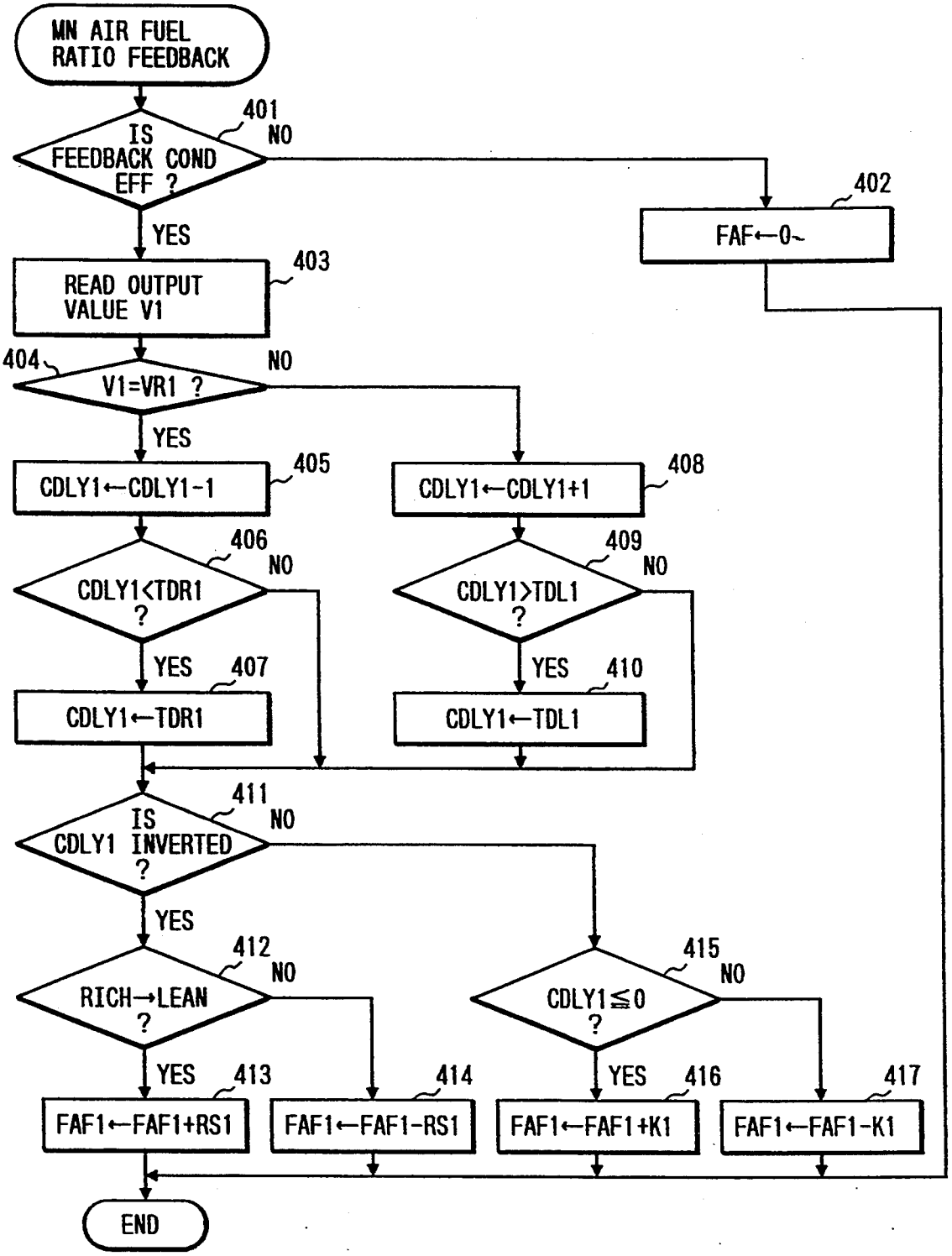
FIG. 7 shows a flow chart representing a main air fuel ratio feedback control routine of this embodiment.

Then, a method of setting of the air fuel ratio compensation coefficient FAF will be described. FIG. 7 shows a flow chart representing a main air fuel ratio feedback control routine for calculating the air fuel ratio compensation coefficient FAF in accordance with the output value V1 (a first output value) of the first oxygen sensor 12. This main air fuel ratio feedback control routine is started and executed at every predetermined interval (for example, 4 msec in this embodiment).

At first, in a step 401, a decision is made as to whether the main air fuel ratio feedback condition is effected or not. The main air fuel ratio feedback condition is that, for example in this embodiment, the engine has been started and the first oxygen sensor 12 is in an active condition or the like. If the main air fuel ratio feedback condition is judged that the main air fuel ratio feedback condition is not effected, processing proceeds to a step 402. In the step 402, the air fuel ratio compensation coefficient FAF is set to 0 (FAF→0).

If the main air fuel ratio feedback condition is judged that the main air fuel ratio feedback condition is effected, the central processing unit executes the main air fuel ratio feedback control after a step 403.

Figure 10:
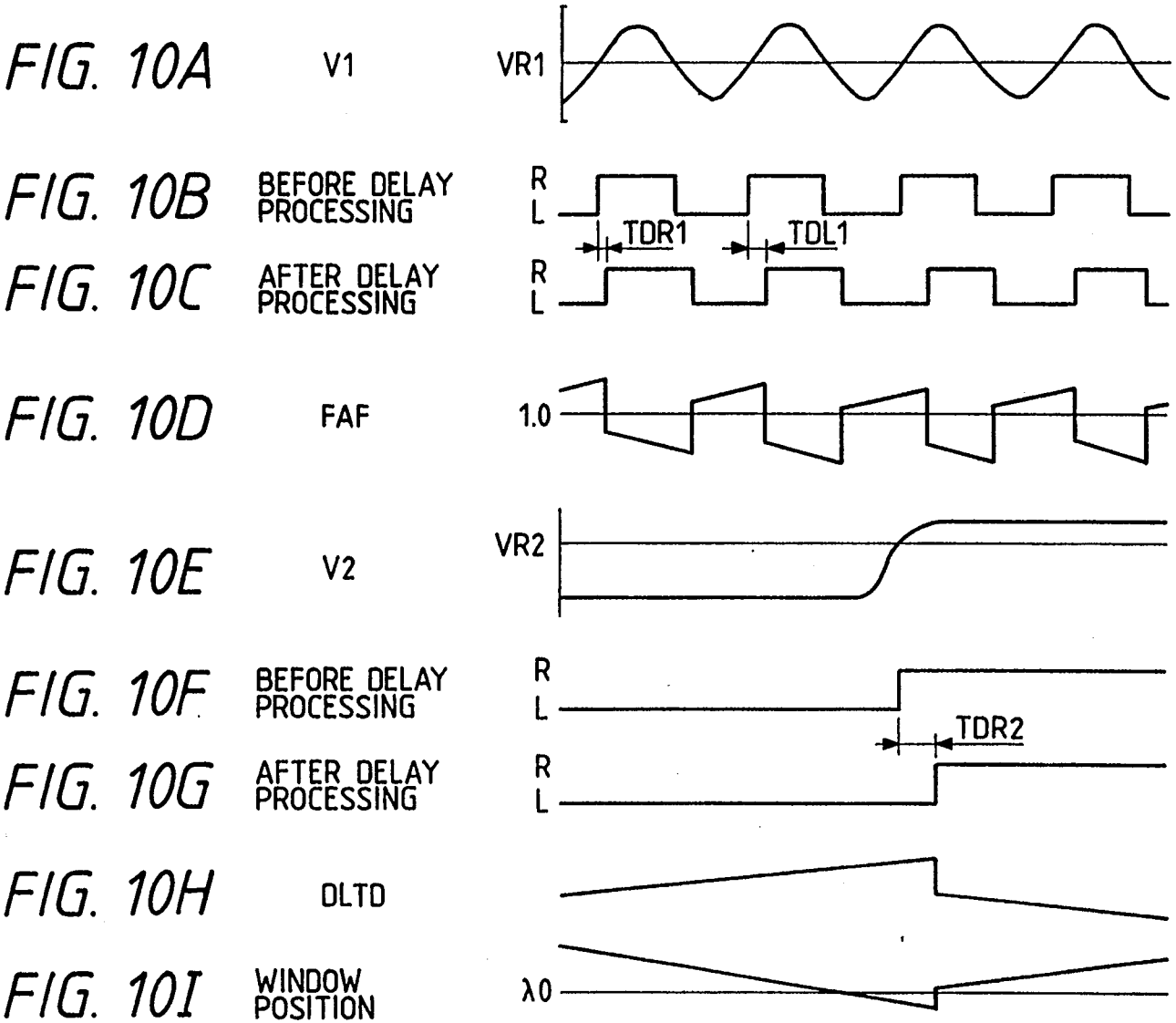
FIGS. 10A to 10I are explanatory drawings of this embodiment.

In the step 403, the central processing unit 20*a* reads out the first output value V1. In the following step 404, a decision is made as to whether the first output value V1 is equal to or less than a first reference voltage VR1 (for example, in this embodiment, 0.45 V) or not, that is, whether the air fuel ratio is in a rich condition or a lean condition. That is, the output value V1 of the oxygen sensor 12 as shown in FIG. 10A is judged as shown in FIG. 10B. If the first output value V1 is equal to or less than the first reference voltage VR1, that is, the air fuel ratio is in a lean condition, processing proceeds to a step 405. In the step 405, the central processing unit 20*a* decreases a value of a first delay counter CDLY1 by one (CDLY1→CDLY1−1).

In the following steps 406 and 407, the first delay counter CDLY1 is guarded using a first rich delay interval TDR1. That is, in the step 406, a decision is made as to whether the value of the first delay counter CDLY1 is less than the first rich delay interval TDR1. If the value of the first delay counter CDLY1 is less than the first rich delay interval TDR1, processing proceeds to the step 407. In the step 407, the central processing unit 20*a* sets the value of the first delay counter CDLY1 to the first rich delay interval TDR1 again.

On the other hand, in the step 404, if the first output value V1 is larger than the first reference voltage VR1, that is, the air fuel ratio is in a rich condition, processing proceeds to a step 408. In the step 408, the central processing unit 20*a* increases the value of the first delay counter CDLY1 by one (CDLY1→CDLY1+1).

In the following steps 409 and 410, the first delay counter CDLY1 is guarded using a first lean delay interval TDL1. That is, in the step 409, a decision is made as to whether the value of the first delay counter CDLY1 is larger than the first rich delay interval TDR1. If the value of the first delay counter CDLY1 is equal to or larger than the first lean delay interval TDL1, processing proceeds to the step 410. In the step 410, the central processing unit 20*a* sets the value of the first delay counter CDLY1 to the first lean delay interval TDL1 again.

A count value corresponding to the delay interval of the rich side, which is defined with a negative value, is set to the first rich delay interval TDR1 mentioned above. This delay interval of the rich side is provided for maintaining the Judgement that the output signal of the first oxygen sensor 12 shows a lean condition though this output signal shows a transition from a lean condition to a rich condition as shown in FIG. 10C. A count value corresponding to the delay interval of the lean side, which is defined with a positive value, is set to first lean delay interval TDL1 mentioned above. This delay interval of the lean side is provided for maintaining the Judgement that the output signal of the first oxygen sensor 12 shows a rich condition though this output signal shows a transition from a rich condition to a lean condition as shown in FIG. 10C.

If the value of the first delay counter CDLY1 is positive with respect to a reference of zero, the air fuel ratio after the delay processing is judged as to be in a rich condition. If the value of the first delay counter CDLY1 is negative, the air fuel ratio after the delay processing is judged as to be in a lean condition. These first rich delay interval TDR1 and first lean delay interval TDL1 are compensated by a sub-air-fuel ratio feedback control in accordance with the output signal of the second oxygen sensor 13.

In a step 411, a decision is made as to whether or not a sign of the first delay counter CDLY1 set mentioned above is inverted, that is, a decision is made as to whether or not the air fuel ratio after the delay processing transits. If the air fuel ratio after the delay processing transits, a skip processing is executed in steps 412 to 414.

In the step 412, a decision is made as to whether the transition is that from a rich condition to a lean condition or not. If the transition is judged as that from the rich condition to the lean condition, processing proceeds to a step 413. In the step 413, the air fuel ratio compensation coefficient FAF is increased by a skip amount RS1 (FAF→FAF+RS1). If the transition is Judged as that from the lean condition to the rich condition, processing proceeds to a step 414. In the step 414, the air fuel ratio compensation coefficient FAF is decreased by the skip amount RS1 (FAF→FAF−RS1).

On the other hand, in the step 411, if the air fuel ratio after the delay processing does not transit, an integration processing is executed in step 415 to 417. In the step 415, a decision is made as to whether or not the first delay counter CDLY1 is equal to or less than 0, that is, whether the air fuel ratio is in a rich condition or a lean condition. If it is judged as to be in a lean condition, processing proceeds to a step 416, the air fuel ratio compensation coefficient FAF is increased by a first integration constant K1 (FAF→FAF+K1). If the air fuel ratio is Judged as to be in a rich condition, processing proceeds to a step 417, the air fuel ratio compensation coefficient FAF is decreased by a first integration constant K1 (FAF→FAF−K1).

Then, the main air fuel ratio feedback control routine is finished.

Therefore, use of the first oxygen sensor 12 having a powerful catalyst function provides an accurate detection whether the air fuel ratio is in a rich condition or a lean condition because the first output value V1 always changes when the air fuel ratio is in a theoretical air fuel ratio of the gas engine 1 though the first oxygen sensor 12 is exposed to the unbalanced combustion gas. In other words, the air fuel ratio can be so set that the catalytic converter rhodium 11 purifies the exhaust gas most efficiently.

In this main air fuel ratio feedback control, the first integration constant K1 is set to a sufficiently smaller value than the first skip amount RS1, so that in a lean condition the air fuel compensation coefficient FAF increases gradually as shown in FIG. 10E. Therefore, the fuel gas supplied increases gradually to control the air fuel ratio to the rich side. In a rich condition, the air fuel compensation coefficient FAF decreases gradually. Therefore, the fuel gas supplied decreases gradually to control the air fuel ratio to the rich side.

Figure 9:
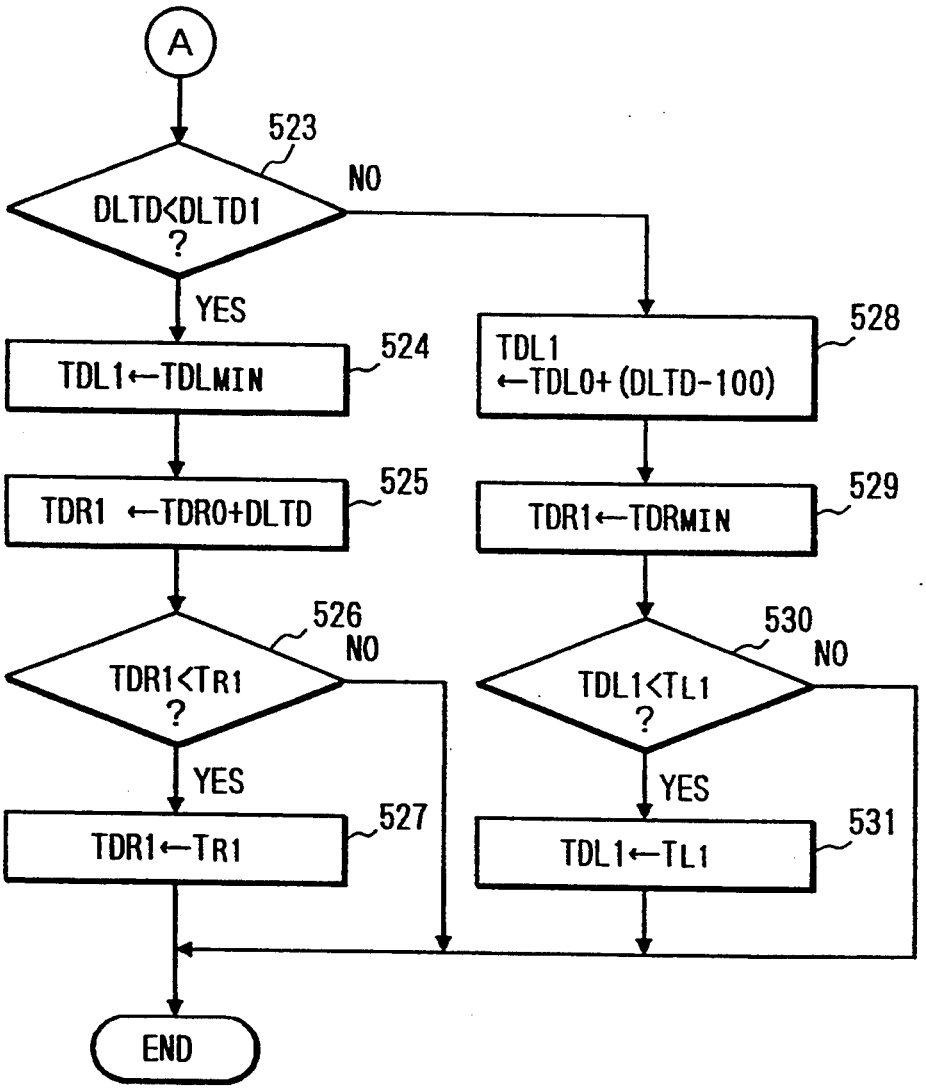

FIGS. 8 and 9 shows a flow chart of the sub-air-fuel-ratio feedback control routine for setting the delay interval used in the main air fuel ratio feedback control, that is, the first rich delay interval TDR1 and the first lean delay interval TDL1, in accordance with the output value V2 of the second oxygen sensor 13 (the second output value) shown in FIG. 10E. This sub-air-fuel-ratio feedback control routine is started and executed at every predetermined interval (for example, in this embodiment, 1 Sec).

At first, in a step 501, a decision is made as to whether a sub-air-fuel-ratio feedback condition is effected or not. For example, in this embodiment, the sub-air-fuel-ratio feedback condition should satisfies the following both conditions: (1) the main air fuel ratio feedback condition is effected; and (2) the second oxygen sensor 13 is in an active condition.

If the sub-air-fuel-ratio feedback condition is judged as to be not effected, processing proceeds to a step 502. In the step 502, a learning value DLTDAV motioned later is substituted for a delay compensation value DLTD0 of the last time (DLTD0→DLTDAV) to prepare the sub-air fuel-ratio control of the next time of sub-air fuel-ration control. In the following step 503, the learning value DLTDAV is substituted for the delay compensation value DLTD (DLTD→DLTDAV) and processing proceeds to a step 523.

If the sub-air-fuel-ratio feedback condition is judged that it is effected, the central processing unit 20*a* executes processing after the step 504.

Figure 14:
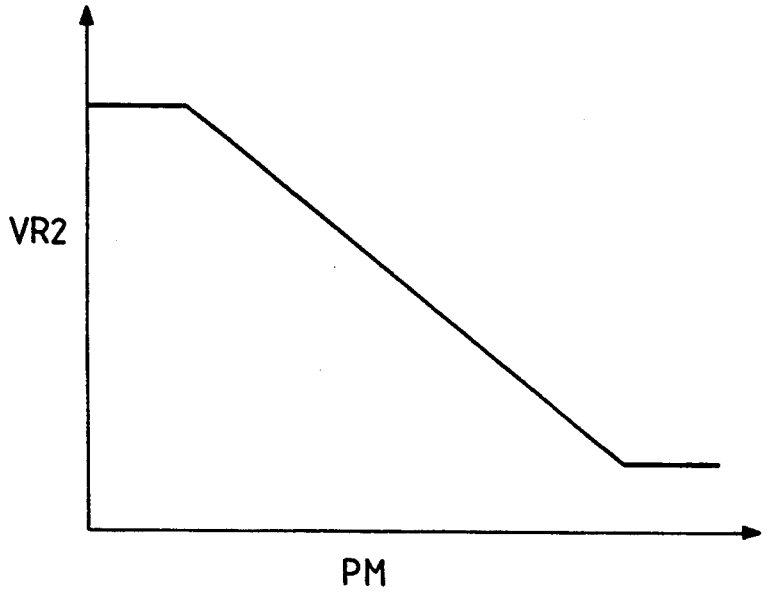
FIG. 14 shows a relation between the intake air pressure PM and the second reference voltage VR2 of this embodiment.
Figure 15A:
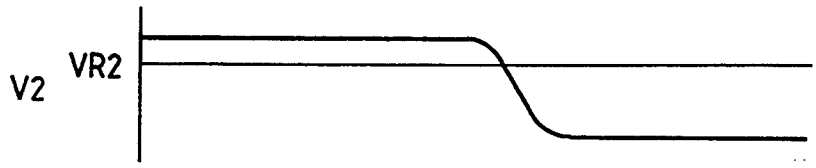
FIGS. 15A to 15D showing time charts of this embodiment.
Figure 15B:
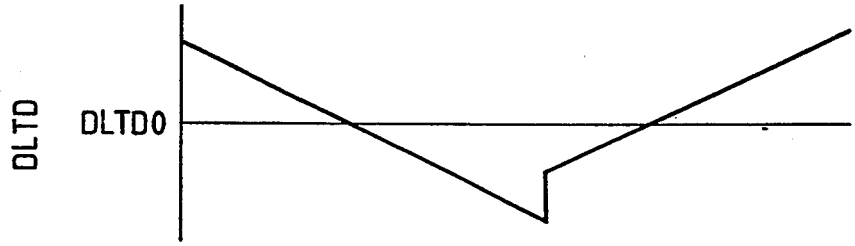
Figure 15C:
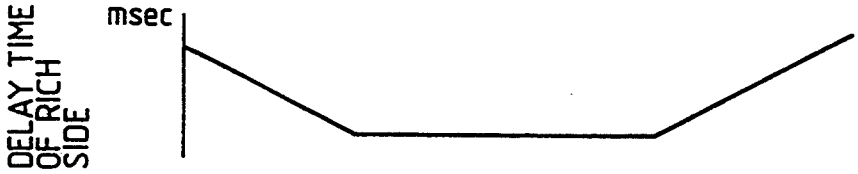
Figure 15D:
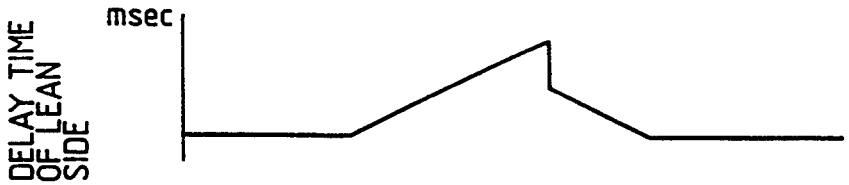

In the step 504, the central processing unit 20*a* reads out the second output value V2. In the following step 505, the central processing unit 20a sets a second reference voltage VR2 in accordance with the intake air pressure PM. There is a relation between the intake air pressure PM and the second reference voltage VR2 as shown in FIG. 14 such that the second reference voltage VR2 decreases with increase in the intake air pressure PM.

In the following step 506, a decision is made as to whether the second output value V2 is equal to or less than the second reference voltage VR2 or not, that is, whether the air fuel ratio detected by the second oxygen sensor 13 is in a rich condition or a lean condition as shown in FIG. 10F. If the second output value V2 is equal to or less than the second reference voltage VR2, that is, the air fuel ratio is in a lean condition, processing proceeds to a step 507. In the step 507, the central processing unit 20*a* decreases a value of a second delay counter CDLY2 by one (CDLY2→CDLY2−1).

In the following steps 508 and 509, the second delay counter CDLY2 is guarded using a second rich delay interval TDR2 and processing proceeds to a step 513. That is, in the step 508, a decision is made as to whether the value of the second delay counter CDLY2 is less than the second rich delay interval TDR2. If the value of the second delay counter CDLY2 is less than the second rich delay interval TDR2, processing proceeds to the step 509. In the step 509, the central processing unit 20*a* sets the value of the second delay counter CDLY2 to the second rich delay interval TDR2 again.

On the other hand, in the step 506, if the second output value V2 is larger than the second reference voltage VR2, that is, the air fuel ratio is in a rich condition, processing proceeds to a step 510. In the step 510, the central processing unit 20*a* increases the value of the second delay counter CDLY2 by one (CDLY2→CDLY2+1).

In the following steps 511 and 512, the second delay counter CDLY2 is guarded using a second lean delay interval TDL2 and processing proceeds to the step 513. That is, in the step 511, a decision is made as to whether the value of the second delay counter CDLY2 is larger than the second rich delay interval TDR2. If the value of the second delay counter CDLY2 is equal to or larger than the second lean delay interval TDL2, processing proceeds to the step 512. In the step 512, the central processing unit 20*a* sets the value of the second delay counter CDLY2 to the second lean delay interval TDL2 again.

A count value corresponding to the delay interval of the rich side, which is defined with a negative value, is set to the second rich delay interval TDR2 mentioned above. This delay interval of the rich side is provided for maintaining the judgement that the output signal of the second oxygen sensor 13 shows a lean condition though this output signal shows a transition from a lean condition to a rich condition as shown in FIG. 10G. A count value corresponding to the delay interval of the lean side, which is defined with a positive value, is set to the second lean delay interval TDL1 mentioned above. This delay interval of the lean side is provided for maintaining the judgement that the output signal of the second oxygen sensor 13 shows a rich condition though this output signal shows a transition from a rich condition to a lean condition.

If the value of the second delay counter CDLY2 is positive with respect to a reference of zero, the air fuel ratio after the delay processing is assumed as to be in a rich condition. If the value of the second delay counter CDLY1 is negative, the air fuel ratio after the delay processing is assumed as to be in a lean condition.

In a step 513, a decision is made as to whether or not a sign of the second delay counter CDLY2 set mentioned above is inverted, that is, a decision is made as to whether or not the air fuel ratio after the delay processing transits. If the air fuel ratio after the delay processing transits, processing proceeds to a step 514. In the step 514, an average value of the delay compensation value DLTD0 of the last time and the delay compensation value DLTD is substituted for the learning value DLTDAV (DLTDAV→(DLTD0+DLTD)/2).

In the following step 515, the delay compensation value DLTD is substituted for the delay compensation value DLTD0 (DLTD0→DLTD) and then processing proceeds to a step 516. In the step 516, a decision is made as to whether the transition is that from a rich condition to a lean condition or not. If the transition is judged as that from the rich condition to the lean condition, processing proceeds to a step 517. In the step 517, the delay compensation value DLTD is decreased by a second rich skip amount SSR (DLTD→DLTD−SSR) and processing proceeds to a step 523. If the transition is judged as that from the lean condition to the rich condition, processing proceeds to a step 518. In the step 518, the delay compensation value DLTD is increased by the second lean skip amount SSL (DLTD→DLTD+SSL) and processing proceeds to the step 523. The second rich skip amount SSR is set to a value equal to or more than the second lean skip amount SSL (in this embodiment, the second rich skip amount SSR is set to a value equal to the second lean skip amount SSL).

Figure 16:
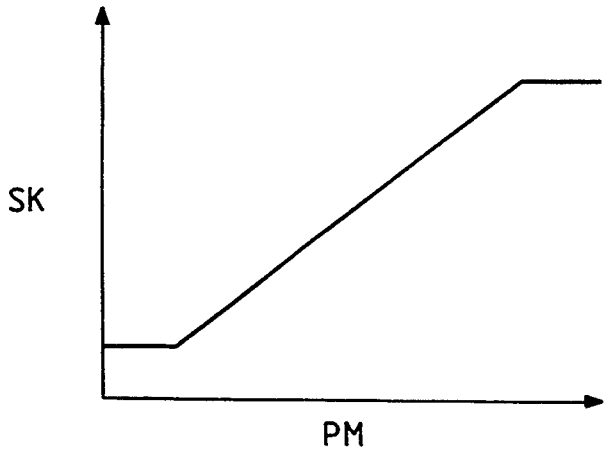
FIG. 16 shows a relation between the second integration constant SK and the intake air pressure PM of this embodiment.

On the other hand, in the step 513, if the air fuel ratio after the delay processing does not transit, processing proceeds to a step 519. In the step 519, a second integration constant. SK is set in accordance with the intake air pressure PM. The intake air pressure PM and the second integration constant are set such that the smaller the intake air pressure PM the smaller the second integration constant as shown in FIG. 16 showing a relation between the second integration constant SK and the intake air pressure PM.

In the following step 520, a decision is made as to whether or not the second delay counter CDLY2 is equal to or less than 0, that is, whether the air fuel ratio is in a rich condition or a lean condition. If it is judged as to be in a lean condition, processing proceeds to a step 512, the delay compensation value DLTD is decreased by a second integration constant SK set in the step 519 (DLTD→DLTD−SK) and processing proceeds to the step 523. In the step 520, if the air fuel ratio is judged as to be in a rich condition, processing proceeds to a step 522. In the step 522, the delay compensation value DLTD is increased by the second integration constant SK (DLTD→DLTD+SK) and processing proceeds to the step 523.

In the step 523, a decision is made as to whether the delay compensation value DLTD set as mentioned above is less than a reference value DLTD1. The reference value DLTD1 is used in the following equation.

$$TDRMIN = TDR0\ 30\ DLTD1 \quad (4)$$

where TDRMIN is a counter value corresponding to a minimum time interval of the delay interval of the rich side in the main air fuel ratio feedback control. Moreover, because the first rich delay interval TDR1 is defined as a negative value as mentioned above, TDRMIN corresponds to an upper limit value of the first rich delay interval TDR1. TDR0 is a counter value corresponding to an initial value of the first rich delay interval TDR1.

In the step 523, if the delay compensation value DLTD is less than the reference value DLTD, that is, the first rich delay interval TDR1 compensated by the delay compensation delay DLTD, is less than the upper limit value TDRMIN, processing proceed to a step 524. In the step 524, the first lean delay interval TDL1 is set to a minimum value TDLMIN. The minimum value TDLMIN is a minimum value of the first lean delay interval TDL1. In the following step 525, a sum of the delay compensation value DLTD and the initial value TDR0 is substituted for the first rich delay interval TDR1 (TDR1→TDR0+DLTD).

In the following steps 526 and 527, the first rich delay interval TDR1 is guarded using a lower limit value TR1. That is, in the step 526, a decision is made as to whether the first rich delay interval TDR1 is less than the lower limit value TR1 which is a counter value corresponding to a maximum interval of the delay interval of the rich side in the main air fuel ratio feedback control.

If the first rich delay interval TDR1 is less than the lower limit value TR1 in the step 525, processing proceeds to a step 527. In the step 527, the first rich delay interval TDR1 is set to the lower limit value TR1 again.

On the other hand, in the step 523, if the delay compensation value DLTD is equal to or larger than the reference value DLTD1, that is, the first rich delay interval TDR1 compensated by the delay compensation value DLTD is equal to or larger than the upper limit value TDRMIN, processing proceeds to a step 528. In the step 528, the first lean delay interval TDL1 is set (TDL1→TDL0+(DLTD−100)) where TDL0 is an initial value of the first lean delay interval TDL1.

In the following step 529, the first rich delay interval TDR1 is set to the upper limit value TDRMIN and central processing unit 20a executes a guard proceeding of steps 530 and 531. That is, in the step 530, a decision is made as to whether the first lean delay interval TDL1 is larger than an upper limit value TL1. If the first lean delay interval TDL1 is larger than an upper limit value TL1, processing proceeds to a step 531. In the step 531, the first lean delay interval TDL1 is set to an upper limit value TL1 again (TDL1→TL1) and then the processing of this routine is finished.

In the sub-air-fuel-ratio feedback control, the second integration constant SK is set to a sufficiently smaller value than the second skip amount SSR and SSL, so that in a lean condition, the delay compensation amount DLTD increases gradually or the first lean delay interval TDL1 decreases. Moreover, when the air fuel ratio is in the rich condition, the first lean delay interval TDL1 decreases gradually, so that the first rich delay interval TTDR1 decreases gradually or the first lean delay interval TDL1 increases. Therefore, use of the oxygen sensor having a low catalytic function provides the center of controlling of the air fuel ratio of the air fuel mixture supplied to the gas engine 1 is controlled to the position of the window as shown in FIG. 10I due to the reason described with reference to FIG. 5.

Moreover, the first delay interval compensated by the sub-air-fuel-ratio feedback control is as follows:

If the delay compensation amount DLTD is equal to or larger than the basic value DLTD1 as shown in FIGS. 15A to 15D showing time charts of this embodiment, that is if the delay interval of the rich side is set to a larger value than the minimum interval, the delay interval of the lean side is set to the minimum interval and the delay interval of the rich side is set in accordance with the delay compensation amount DLTD.

On the other hand, if the delay compensation amount DLTD is equal to or less than the basic value DLTD1, that is, the delay interval of the rich side, is set to a value equal to or less than the minimum interval, the delay interval of the rich side is set to the minimum interval and the delay interval of the lean side is set in accordance with the delay compensation amount DLTD. Through this calculation, the delay interval for either the rich side or lean side is set to the minimum interval, so that the delay interval in the main air-fuel ratio feedback control is kept at a longer value. Therefore, the purification ratio of the catalytic converter is prevented from decreasing because of the control frequency decrease in the main air-fuel ratio feedback control.

Figure 18:
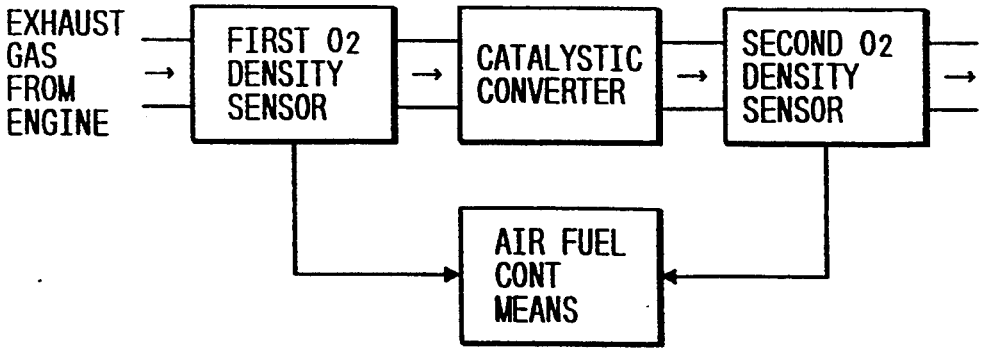
FIG. 18 is a functional block diagram of this embodiment.

FIG. 18 is a functional block diagram of the embodiment shown in FIG. 1.

In this embodiment, the bypass supply passage 7 as shown in FIG. 1, is opened at the upstream of the choke valve 5, so that the fuel gas is bypassed to the upstream from the choke valve 5. However, it is possible that the fuel gas is bypassed to the downstream from the choke valve or the intake air is bypassed in place to the fuel gas. Moreover, the fuel can be supplied with a not-shown injection valve.

Figure 17:
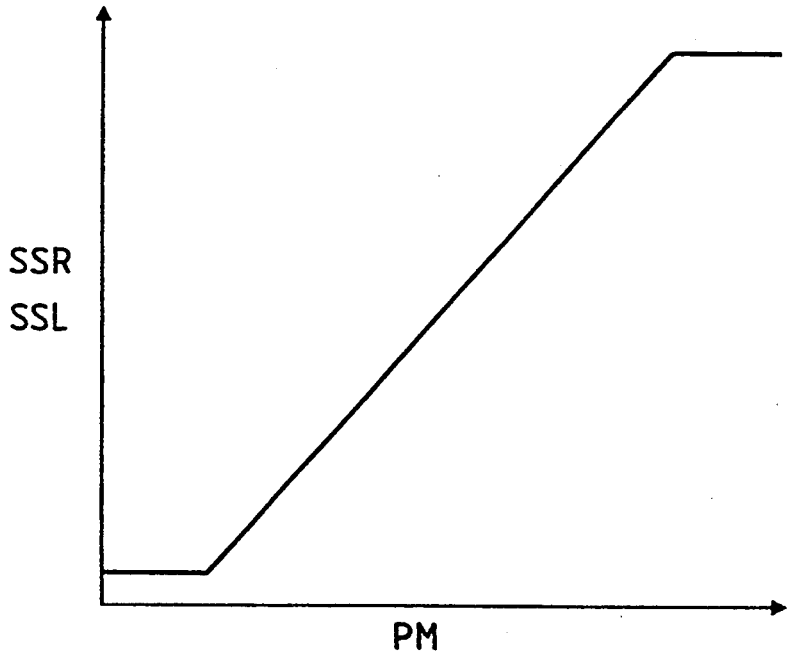
FIG. 17 shows a relation between the skip amounts SSR and SSL and the intake air pressure PM of this embodiment.

Further, in the embodiment mentioned above, the second reference voltage VR2 and the second integration constant SK are set in accordance with a flow velocity of the mixture gas. However, it is possible that the second skip amounts SSL and SSR are set in accordance with the intake air pressure PM using the characteristic shown in FIG. 17 showing a relation between the skip amounts SSR and SSL and the intake air pressure PM.

Moreover, in the embodiment mentioned above, the control method of the invention applied to the gas engine 1 is described. However, this invention is applicable to other internal combustion engines such as a gasoline engine or the like.

Further, in the embodiment mentioned above, the delay interval used in the processing of the output signal of the first oxygen sensor 12 is compensated in accordance with the output signal of the second oxygen sensor 13. However, it is possible that other parameter (for example, the integration constant, the skip amount, the reference voltage) used in the processing of the first oxygen sensor 12 can be compensated.

Moreover, in the embodiment mentioned above, the second oxygen sensor 13 having no catalyst layer is provided downstream from the catalytic converter rhodium 11 in order to surely follow the deviation of the window position against deterioration of the catalytic converter rhodium. However, it is possible that the second oxygen sensor 13 has a catalyst layer having a lower catalytic function than that of the first oxygen sensor 12. Further, the embodiment mentioned above, the catalyst layer 35 is formed in the first oxygen sensor having a powerful catalytic function. However, other methods are possible which emphasize the catalytic function of the first oxygen sensor 12 by heating the first oxygen sensor 12 with a heater 25 to a higher temperature than that of the second oxygen sensor 13.

As mentioned above, this invention provides controlling of the air fuel ratio of the internal combustion engine to increase the purification ratio of the catalytic converter rhodium by accurately detecting the theoretical air fuel ratio continuously though the exhaust gas is in an unbalanced condition or a low temperature condition by controlling the air fuel ratio of the internal combustion engine on the basis of the detection result of the first and second oxygen density sensors which first oxygen sensor is provided upstream of a catalytic converter rhodium for purifying the exhaust gas generated in the internal combustion engine and which second oxygen sensor is provided down stream from the catalytic converter rhodium, a function for oxidizing or reducing a specific components included in the exhaust gas of the first oxygen density sensor is more powerful than that of the second oxygen sensor.

Moreover, this invention provides controlling of the air fuel ratio to that capable of the most efficient purification in the catalytic converter rhodium continuously by accurately detecting the deviation of the region where the purify efficiency is high against the deterioration of the catalytic converter rhodium, or the like.

What is claimed is:

1. An air-fuel ratio controlling apparatus for an internal combustion engine exhausting through a catalytic converter provided in an exhaust system of said internal combustion engine for purifying a first exhaust gas of said internal combustion engine, comprising:

a first oxygen density sensor, provided upstream from said catalytic converter in said exhaust system, responsive to a first oxygen density of said first exhaust gas of said internal combustion engine, for detecting whether an air-fuel ratio of said internal combustion engine is in a rich condition or a lean condition with respect to a theoretical air-fuel ratio of said internal combustion engine, said first oxygen density sensor comprising a catalyst for oxidizing or reducing a specific component in said first exhaust gas;

a second oxygen density sensor, provided downstream from said catalytic converter in said exhaust system, responsive to a second oxygen density of a second exhaust gas passed through said catalytic converter, for detecting whether said air-fuel ratio of said internal combustion engine is in said rich condition or said lean condition with respect to said theoretical air-fuel ratio of said internal combustion engine, said second oxygen density sensor being made of a material that oxidizes or reduces said specific component in said second exhaust gas to a lesser degree than said first oxygen sensor; and air-fuel ratio control means for controlling said air-fuel ratio in accordance with said detected rich condition or lean condition of said internal combustion engine by said first and second oxygen sensors.

2. An air-fuel ratio controlling apparatus for an internal combustion engine as claimed in claim 1, wherein said first oxygen density sensor comprises:

(a) a solid electrolyte formed in a tube having one open end and one closed end;

(b) a first electrode layer coated on a portion of the inner surface of said tube;

(c) a second electrode layer covering a portion of the outer surface of said tube, said solid electrolyte, said first, and second electrode layers forming an oxygen concentration cell;

(d) a protective layer covering said second electrode; and (e) a catalyst layer, covering said protective layer, for oxidizing or reducing said specific component.

3. An air-fuel ratio controlling apparatus for an internal combustion engine as claimed in claim 1, wherein said second oxygen density sensor comprises:

(a) a solid electrolyte formed in a tube having one open end and one closed end;

(b) a first electrode layer coated on a portion of the inner surface of said tube;

(c) a second electrode layer covering a portion of the outer surface of said tube, said solid electrolyte, said first; and second electrode layers forming an oxygen concentration cell;

(d) a protective layer, covering said second electrode; and (e) a second catalyst layer, covering said protective layer, for oxidizing or reducing said specific component less than said first oxygen sensor.

4. An air-fuel ratio controlling apparatus for an internal combustion engine being supplied with a gaseous fuel including methane gas, exhausting through a catalytic converter located in an exhaust system of said internal combustion engine for purifying a first exhaust gas of said internal combustion engine, comprising:

a first oxygen density sensor, provided upstream from said catalytic converter in said exhaust system, responsive to a first oxygen density of said first exhaust gas of said internal combustion engine for detecting whether an air-fuel ratio of said internal combustion engine is in a rich condition or a lean condition with respect to a theoretical air-fuel ratio of said internal combustion engine, said first oxygen density sensor comprising a catalyst for oxidizing or reducing a specific component in said first exhaust gas;

a second oxygen density sensor, provided downstream from said catalytic converter in said exhaust system, responsive to a second oxygen density of a second exhaust gas passed through said catalytic converter for detecting whether said air-fuel ratio is in said rich condition or said lean condition with respect to said theoretical air-fuel ratio of said internal combustion engine, said second oxygen density sensor being made of a material that oxidizes or reduces said specific component in said second exhaust gas to a lesser degree than said first oxygen sensor; and air-fuel ratio control means for controlling said air-fuel ratio in accordance with said detected rich condition or lean condition of said internal combustion engine by said first and second oxygen sensors.

5. An air-fuel ratio controlling apparatus for an internal combustion engine as claimed in claim 4, wherein said first oxygen density sensor comprises:

(a) a solid electrolyte formed in a tube having one open end and one closed end;

(b) a first electrode layer coated on a portion of the inner surface of said tube;

(c) a second electrode layer covering a portion of the outer surface of said tube, said solid electrolyte, said first, and second electrode layers forming an oxygen concentration cell;

(d) a protective layer covering said second electrode; and (e) a catalyst layer, covering said protective layer, for oxidizing or reducing said specific component.

6. An air-fuel ratio controlling apparatus for an internal combustion engine being supplied with a gasoline, exhausting through a catalytic converter provided in an exhaust system of said internal combustion engine for purifying a first exhaust gas of said internal combustion engine comprising:

a first oxygen density sensor, provided upstream from said catalytic converter in said exhaust system, responsive to a first oxygen density of a first exhaust gas of said internal combustion engine for detecting whether an air-fuel ratio is in a rich condition or a lean condition with respect to a theoretical air-fuel ratio of said internal combustion engine and, said first oxygen density sensor comprising a first oxidizing means for oxidizing or reducing a specific element in said first exhaust gas;

a second oxygen density sensor, provided downstream from said catalytic converter in said exhaust system, responsive to a second oxygen density of a second exhaust gas passed through said catalytic converter for detecting whether said air-fuel ratio of said internal combustion engine is in said rich condition or said lean condition with respect to said theoretical air-fuel ratio of said internal combustion engine, said second oxygen density sensor comprising a second oxidizing means for oxidizing or reducing said specific element in said second exhaust gas to a lesser degree than said first oxidizing means could oxidize and, reduce said specific element in said second exhaust gas; and air-fuel ratio control means for controlling said air-fuel ratio in accordance with said detected rich condition or said lean condition of said internal combustion engine by said first and said second sensors.

7. The air-fuel ratio controlling apparatus of claim 1, wherein said internal combustion engine is adapted to operate using methane gas.

8. An air-fuel ratio controlling apparatus on claim 2, wherein said first oxygen density sensor further comprises means for heating said first oxygen density sensor so that said first oxygen density sensor maintains a higher temperature than said second oxygen density sensor.

9. An air-fuel ratio controlling apparatus for an internal combustion engine exhausting through a catalytic converter provided in an exhaust system of said internal combustion engine for purifying a first exhaust gas of said internal combustion engine, comprising:

a first oxygen density sensor, provided upstream from said catalytic converter, responsive to a first oxygen density of said first exhaust gas, for producing a first output indicative of whether an air-fuel ratio of said internal combustion engine is in a rich condition or a lean condition with respect to a theoretical air-fuel ratio of said internal combustion engine, said first oxygen density sensor having a first quantity of a catalyst providing a first catalytic effect for oxidizing or reducing a predetermined component in said first exhaust gas;

a second oxygen density sensor, provided downstream from said catalytic converter, responsive to a second oxygen density of a second exhaust gas exiting said catalytic converter, and producing a second output for detecting whether said air-fuel ratio of said internal combustion engine is in said rich condition or said lean condition with respect to said theoretical air-fuel ratio, said second oxygen density sensor having means for oxidizing or reducing said predetermined component in a manner less than that provided by said first catalytic effect; and air-fuel ratio control means for controlling said air-fuel ratio in accordance with said detected rich condition or said lean condition of said internal combustion engine by said first and second oxygen sensors.

10. The air-fuel ratio controlling apparatus of claim 9, further comprising heating means for heating said first oxygen density sensor to a first temperature, said first temperature being hotter than a second temperature of said second oxygen density sensor.

11. The air-fuel ratio controlling apparatus of claim 9, wherein said second oxygen density sensor further comprises a second quantity of catalyst, said second quantity of catalyst providing a second catalytic effect for oxidizing or reducing said predetermined component in said second exhaust gas, first catalytic effect being greater than said second catalytic effect.

12. The air-fuel ratio controlling apparatus of claim 11, further comprising heating means for heating said first oxygen density sensor to a first temperature being greater than a second temperature of said second oxygen density sensor.

13. The air-fuel ratio controlling apparatus of claim 9, wherein said first oxygen density sensor comprises:

(a) a solid electrolyte formed in a tube having one open end and one closed end;

(b) a first electrode layer coated on a portion of the inner surface of said tube;

(c) a second electrode layer covering a portion of the outer surface of said tube, said solid electrolyte, said first, and second electrode layers forming an oxygen concentration cell;

(d) a protective layer covering said second electrode; and (e) a catalyst layer, having said first quantity of said catalyst, covering said protective layer, for oxidizing or reducing said specific component.

14. The air-fuel ratio controlling apparatus of claim 9, wherein said internal combustion engine is adapted to operate using methane gas.

15. An air-fuel ratio controlling apparatus for an internal combustion engine exhausting through a catalytic converter provided in an exhaust system of said internal combustion engine for purifying a first exhaust gas of said internal combustion engine, comprising:

a first oxygen density sensor, provided upstream from said catalytic converter in said exhaust system, responsive to a first oxygen density of said first exhaust gas of said internal combustion engine, for detecting whether an air-fuel ratio of said internal combustion engine is in a rich condition or a lean condition with respect to a theoretical air-fuel ratio of said internal combustion engine, said first oxygen density sensor comprising a means for oxidizing or reducing a specific component in said first exhaust gas;

a second oxygen density sensor, provided downstream from said catalytic converter in said exhaust system, responsive to a second oxygen density of a second exhaust gas passed through said catalytic converter, for detecting whether said air-fuel ratio of said internal combustion engine is in said rich condition or said lean condition with respect to said theoretical air-fuel ratio of said internal combustion engine, said second oxygen density sensor being made of a material that oxidizes or reduces said specific component in said second exhaust gas to a lesser degree than said means for oxidizing; and air-fuel ratio control means for controlling said air-fuel ratio in accordance with said detected rich condition or lean condition of said internal combustion engine by said first and second oxygen sensors.

16. An air-fuel ratio controlling apparatus of claim 15, wherein said oxidizing means comprises a heating means.

17. An air-fuel ratio controlling apparatus of claim 15, wherein said oxidizing means comprises a catalyst layer.

18. An air-fuel ratio controlling apparatus for an internal combustion engine as claimed in claim 4, wherein said second oxygen density sensor comprises:

(a) a solid electrolyte formed in a tube having one open end and one closed end;

(b) a first electrode layer coated on a portion of the inner surface of said tube;

(c) a second electrode layer covering a portion of the outer surface of said tube, said solid electrolyte, and said first and second electrode layers forming an oxygen concentration cell;

(d) a protective layer, covering said second electrode; and (e) a second catalyst layer covering said protective layer, for oxidizing or reducing said specific component less than said first oxygen sensor.

19. An air-fuel ratio controlling apparatus for an internal combustion engine as claimed in claim 1, wherein said second oxygen density sensor comprises:

(a) an electrolyte; and (b) a plurality of platinum electrodes provided on said electrolyte, said platinum electrodes oxidizing or reducing said specific component less than said first oxygen sensor.

20. An air-fuel ratio controlling apparatus for an internal combustion engine as claimed in claim 4, wherein said second oxygen density sensor comprises:

(a) an electrolyte; and (b) a plurality of electrodes provided on said electrolyte, at least one of electrodes being made of platinum that oxidizes or reduces said specific component less than said first oxygen sensor.

21. An air-fuel ratio controlling apparatus for an internal combustion engine as claimed in claim 6, wherein said second oxygen density sensor comprises an electrolyte; and said second oxidizing means includes at least one platinum electrode provided on said electrolyte, said platinum electrode oxidizing or reducing said specific component less than said first oxidizing means.

22. An air-fuel ratio controlling apparatus for an internal combustion engine as claimed in claim 15, wherein said second oxygen density sensor comprises:

(a) an electrolyte; and (b) at least one platinum electrode provided on said electrolyte, said platinum electrode oxidizing or reducing said specific component less than said oxidizing means.

* * * * *

UNITED STATES PATENT AND TRADEMARK OFFICE

CERTIFICATE OF CORRECTION

PATENT NO. : 5,417,060

DATED : May 23, 1995

INVENTOR(S) : ISHIDA et al.

It is certified that error appears in the above-identified patent and that said Letters Patent is hereby corrected as shown below:

ON THE TITLE PAGE:

Reads: [73] Assignees: Nippondenso Co., Ltd., Tokyo; Tokyo Gas Co., Ltd., Kariya, both of Japan Should Read: [73] Assignees: Nippondenso Co., Ltd., Kariya; Tokyo Gas Co., Ltd., Tokyo, both of Japan Signed and Sealed this Twenty-fourth Day of October, 1995

*Attest:*

*Attesting Officer*

BRUCE LEHMAN

*Commissioner of Patents and Trademarks*